US008303773B2

(12) United States Patent
Scherb et al.

(10) Patent No.: US 8,303,773 B2
(45) Date of Patent: Nov. 6, 2012

(54) MACHINE FOR THE PRODUCTION OF TISSUE PAPER

(75) Inventors: Thomas Scherb, Sao Paulo (BR); Luiz Carlos Silva, Sao Paulo (BR); Rogerio Berardi, Sao Paulo (BR); Danilo Oyakawa, Sao Paulo (BR)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 13/207,983

(22) Filed: Aug. 11, 2011

(65) Prior Publication Data

US 2011/0290439 A1 Dec. 1, 2011

Related U.S. Application Data

(62) Division of application No. 11/498,470, filed on Aug. 3, 2006, now abandoned.

(30) Foreign Application Priority Data

Aug. 5, 2005 (DE) ..... 10 2005 036 891

(51) Int. Cl.
*D21F 1/10* (2006.01)
*D21F 3/04* (2006.01)
*D21F 7/00* (2006.01)

(52) U.S. Cl. ..... 162/202; 162/198; 162/199

(58) Field of Classification Search ..... 162/109, 162/117, 202–205, 358.1–358.3, 361–364, 162/367–368, 370–373, 900–903; 34/114–116, 34/122–123, 397–400
See application file for complete search history.

(56) References Cited

U.S. PATENT DOCUMENTS

| | | | | |
|---|---|---|---|---|
| 3,266,164 | A | | 8/1966 | Bennett |
| 3,301,746 | A | | 1/1967 | Sanford et al. |
| 3,691,010 | A | * | 9/1972 | Krake ..... 162/206 |
| 4,366,025 | A | * | 12/1982 | Gordon et al. ..... 162/358.1 |
| 4,689,119 | A | | 8/1987 | Weldon |
| 4,834,838 | A | | 5/1989 | Klowak |
| 4,849,054 | A | | 7/1989 | Klowak |

(Continued)

FOREIGN PATENT DOCUMENTS

DE 2652431 A * 5/1977

(Continued)

*Primary Examiner* — Jose A Fortuna
(74) *Attorney, Agent, or Firm* — Taylor IP, P.C.

(57) ABSTRACT

A method of producing a tissue paper web in a papermaking machine including the steps of forming the web on a skin, selecting a quality of the web, bypassing a dewatering apparatus, passing the skin and web through a nip and conveying the web to a drying cylinder from the skin. The web is formed in a forming section of the machine from a pulp suspension on the skin. In the selecting step a quality of the web is selected thereby defining a quality selection of absorbency or tear resistance. The bypassing step includes bypassing the dewatering apparatus with the web and selecting a type of the skin dependent upon the quality selection. The machine being configured to bypass the dewatering apparatus dependent upon the quality selection; when the quality selection is tear resistance then the skin is a non-structured skin or a felt and the dewatering apparatus is bypassed, when the quality selection is the absorbency then the skin is a three-dimensionally structured skin or a structured mesh and the dewatering apparatus is not bypassed. In the passing step the skin and the tissue paper web passes through a nip defined between a cylindrical surface of the drying cylinder and a mating surface of a press roller.

19 Claims, 5 Drawing Sheets

U.S. PATENT DOCUMENTS

| | | | | |
|---|---|---|---|---|
| 5,135,614 | A | 8/1992 | Aula et al. | |
| 5,314,584 | A | 5/1994 | Grinnell et al. | |
| 6,077,398 | A | 6/2000 | Fiscus et al. | |
| 6,103,062 | A | 8/2000 | Ampulski et al. | |
| 6,402,896 | B1 | 6/2002 | Nikulainen et al. | |
| 6,682,632 | B2 | 1/2004 | Nikulainen et al. | |
| 6,998,017 | B2 | 2/2006 | Lindsay et al. | |
| 7,150,110 | B2 | 12/2006 | Herman et al. | |
| 7,291,249 | B2 | 11/2007 | Thoroe-Scherb et al. | |
| 7,294,237 | B2 | 11/2007 | Herman et al. | |
| 7,297,233 | B2 | 11/2007 | Herman et al. | |
| 7,351,307 | B2 | 4/2008 | Scherb et al. | |
| 7,387,706 | B2 | 6/2008 | Herman et al. | |
| 7,428,786 | B2 | 9/2008 | Herman et al. | |
| 7,476,293 | B2 | 1/2009 | Herman et al. | |
| 7,476,294 | B2 | 1/2009 | Herman et al. | |
| 7,510,631 | B2 | 3/2009 | Scherb et al. | |
| 7,582,187 | B2 * | 9/2009 | Scherb et al. | 162/112 |
| 7,744,726 | B2 * | 6/2010 | Scherb et al. | 162/205 |
| 7,767,061 | B2 * | 8/2010 | Urbanek et al. | 162/281 |
| 7,850,825 | B2 * | 12/2010 | Scherb et al. | 162/358.3 |
| 7,927,462 | B2 * | 4/2011 | Scherb et al. | 162/358.3 |
| 7,931,781 | B2 * | 4/2011 | Scherb et al. | 162/358.5 |
| 7,951,269 | B2 * | 5/2011 | Herman et al. | 162/358.3 |
| 2002/0060046 | A1 | 5/2002 | Scherb et al. | |
| 2003/0051849 | A1 | 3/2003 | Ehrola | |
| 2003/0056911 | A1 | 3/2003 | Hermans et al. | |
| 2004/0020614 | A1 | 2/2004 | Lindsay et al. | |
| 2004/0237210 | A1 * | 12/2004 | Thoroe-Scherb et al. | 8/115.51 |
| 2005/0126031 | A1 | 6/2005 | Herman et al. | |
| 2005/0167062 | A1 | 8/2005 | Herman et al. | |
| 2005/0167066 | A1 | 8/2005 | Herman et al. | |
| 2005/0167068 | A1 | 8/2005 | Herman et al. | |
| 2005/0217814 | A1 | 10/2005 | Super et al. | |
| 2006/0085998 | A1 | 4/2006 | Herman et al. | |
| 2006/0085999 | A1 | 4/2006 | Scherb et al. | |
| 2006/0086473 | A1 | 4/2006 | Herman et al. | |
| 2006/0225300 | A1 | 10/2006 | Herman et al. | |
| 2006/0237154 | A1 | 10/2006 | Edwards et al. | |
| 2007/0029061 | A1 * | 2/2007 | Scherb et al. | 162/289 |
| 2007/0062657 | A1 | 3/2007 | Scherb et al. | |
| 2007/0256806 | A1 | 11/2007 | Scherb et al. | |
| 2007/0272385 | A1 | 11/2007 | Quigley et al. | |
| 2008/0023165 | A1 | 1/2008 | Herman et al. | |
| 2008/0029237 | A1 * | 2/2008 | Urbanek et al. | 162/193 |
| 2008/0128104 | A1 | 6/2008 | Scherb et al. | |
| 2008/0149292 | A1 | 6/2008 | Scherb | |
| 2008/0196855 | A1 | 8/2008 | Herman et al. | |
| 2008/0210397 | A1 | 9/2008 | Scherb et al. | |
| 2009/0165979 | A1 * | 7/2009 | Scherb et al. | 162/210 |
| 2009/0165980 | A1 * | 7/2009 | Scherb et al. | 162/210 |
| 2009/0183847 | A1 | 7/2009 | Scherb et al. | |
| 2009/0242158 | A1 | 10/2009 | Scherb et al. | |
| 2010/0170651 | A1 * | 7/2010 | Scherb et al. | 162/202 |
| 2010/0243190 | A1 * | 9/2010 | Scherb et al. | 162/358.3 |
| 2011/0146932 | A1 * | 6/2011 | Herman et al. | 162/205 |
| 2011/0290439 | A1 * | 12/2011 | Scherb et al. | 162/203 |

FOREIGN PATENT DOCUMENTS

| | | | | |
|---|---|---|---|---|
| DE | 10129613 | A1 | * | 1/2003 |
| EP | 1 518 960 | A1 | | 3/2005 |
| EP | 1 626 121 | A1 | | 2/2006 |
| GB | 1515979 | A | * | 6/1978 |
| WO | WO 03000002 | A1 | * | 1/2003 |
| WO | 2005/075732 | A2 | | 8/2005 |
| WO | 2005/075736 | A2 | | 8/2005 |
| WO | 2005/075737 | A1 | | 8/2005 |

* cited by examiner

MACHINE FOR THE PRODUCTION OF TISSUE PAPER

This is a division of U.S. patent application Ser. No. 11/498,470, entitled "MACHINE FOR THE PRODUCTION OF TISSUE PAPER", filed Aug. 3, 2006, now abandoned which is incorporated herein by reference.

BACKGROUND OF THE INVENTION

1. Field of the Invention

The present invention relates to a paper making machine, and, more particularly, to a machine for the production of tissue paper.

2. Description of the Related Art

Many different types of production processes for tissue paper are known.

The expensive TAD method or the method described in PCT/EP2005/050203, for example, are used for the production of a particularly high-quality and fleecy tissue paper with a higher absorbency and high water absorption capacity coupled with high tear resistance. With the method described in PCT/EP2005/050203 the tissue paper web is formed in the forming section on a structured mesh and then dewatered in several dewatering steps under the action of pressure. For example, the tissue paper web is conveyed throughout the dewatering on the structured mesh on which it was formed. In this way a tissue paper with voluminous, less compressed areas, and with compressed solid areas, is formed. With the method described in PCT/EP2005/050203 an elongated nip is formed between the Yankee drying cylinder and a mating surface constructed as a shoe press unit. Thanks to the elongated nip a good transfer from the structured mesh to the Yankee drying cylinder is assured. Here the function performed by the elongated nip is solely to transfer the tissue paper web from the structured mesh to the Yankee drying cylinder. Therefore it would be desirable for the expensive shoe press unit to be replaced by a cheaper press roller. In tests, however, rollers with a solid circumferential surface display poor transfer properties of the tissue paper web from the mesh to the Yankee drying cylinder because a vacuum is generated in the opening nip and leads to the tissue paper web adhering to the mesh. A satisfactory transfer performance is obtained by way of bores in the cylindrical surface of the roller, but the roller casings, known from the prior art with their relatively large bores of more than 3.8 mm, leave unacceptable shadow marks on high-quality tissue paper.

A low production capacity is usually achieved with the above mentioned methods than with methods in which less high-quality, meaning less fleecy and less absorbent tissue papers are produced. Such a method is realized, for example, by way of a paper machine with a crescent arrangement in which the tissue paper web is formed in the forming section on a felt and is conveyed thereon up to the Yankee drying cylinder via an elongated nip formed between the Yankee drying cylinder and a shoe press unit. With this method the drying of the tissue paper web takes place, to an essential extent, in the elongated nip. With this method, too, there is a need, due to pressure from costs, to replace the expensive shoe press unit with a cheaper press roller. However, tests in this connection have shown that rollers with a solid circumferential surface and rollers with blind bores are not suitable for replacing the shoe press unit due to too low a dewatering performance.

Furthermore, manufacturers of tissue paper face changing requirements with regard to the quality and quantity of the tissue paper to be produced. For example, tissue paper manufacturers have to provide their customers periodically with high-quality fleecy tissue paper in small quantities and periodically with less high-quality tissue paper often in large quantities.

The provision of production machines for both methods is costly for the tissue paper manufacturer as this means on the one hand that both types of production machines have to be purchased and on the other hand that depending on the current market demands the one or other machine cannot be used for production.

SUMMARY OF THE INVENTION

It is the object of the present invention to propose a machine which is suitable both for the production of high-quality tissue paper and for the production of less high-quality tissue paper.

The known machine for the production of a tissue paper web has a forming section in which the tissue paper web is formed from a pulp suspension on a skin. Furthermore, the machine has a nip formed between the cylindrical surface of a drying cylinder, in particular a Yankee drying cylinder, and a mating surface, through which the tissue paper web can be conveyed together with the skin.

On the machine according to an embodiment of the present invention provision is made for the configuration of the machine to be variable depending on the quality of the tissue paper to be produced. For example, the variability includes absorbency or tear resistance, the skin is either a three-dimensionally structured skin, in particular a structured mesh, or a non-structured skin, in particular a felt, whereby the mating surface is formed by the cylindrical surface of a press roller having a suction zone and whereby provision is made for bores arranged in the cylindrical surface communicating with the suction zone.

Thanks to the present invention a machine is provided with which it is possible, depending on the skin selected, to produce either high-quality voluminous tissue paper or less high-quality and less voluminous tissue paper. When using the 3-dimensionally structured and permeable skin, in particular the structured mesh, the tissue paper web is formed and dewatered on the structured mesh, as the result of which the tissue paper web acquires in some areas a voluminous structure with a high gsm substance. Thanks to the use of a press roller with bores for the nip formed with the drying cylinder, in particular a Yankee cylinder, a good transfer of the tissue paper web from the structured mesh to the drying cylinder is assured.

The high-quality and voluminous tissue paper has, preferably, a bulk value of 10 or more $cm^3/g$, preferably 10-16 $cm^3/g$, and a water retention capacity of 10 g water per g fibers, preferably 10-16 g water per g fibers.

When using the non-structured permeable skin, in particular the felt, the tissue paper web is formed and dewatered on the skin. As the result of which the tissue paper web acquires a less voluminous structure than when using the structured mesh. In return, such a tissue paper web can be produced with greater productivity (in tons of tissue per unit of time) on account of the higher machine speed. Thanks to the use of a press roller with bores for the nip formed with the drying cylinder, in particular a Yankee cylinder, a good transfer of the tissue paper web from the non-structured skin to the drying cylinder is assured. Furthermore, when the tissue paper machine is operated with the non-structured permeable skin, for example the felt, the press roller is evacuated, thus ensuring a sufficient dewatering performance by the nip.

The less high-quality and less voluminous tissue paper has a bulk value of less than 10 $cm^3/g$, preferably 6-9 $cm^3/g$, and a water retention capacity of less than 10 g water per g fibers, preferably 6-9 g water per g fibers.

In practice it has turned out that the three-dimensionally structured and permeable skin, in particular the structured mesh, is used advantageously for the production of tissue paper with higher absorbency, and the non-structured skin, in particular the felt, advantageously for the production of tissue paper with lower absorbency. Tests have shown that the dry content of the tissue paper web during operation with the 3-dimensionally structured and permeable skin cannot be increased through evacuation of the press roller, which is why the press roller can be operated without evacuation in this case.

Also, tests have shown that the transfer performance of the tissue paper web to the drying cylinder can be increased during operation with the 3-dimensionally structured and permeable skin when the press roller has a blowing zone. The lifting of the tissue paper web from the press roller is facilitated by the gas flow generated by the blowing zone.

Between the forming section and the nip the machine has a dewatering apparatus, which can be operated in relation to the nip such that the tissue paper web is dewatered by the dewatering apparatus to a greater extent during operation with the structured and permeable skin and to a smaller extent during operation with the non-structured and permeable skin than by the nip. Tests with the structured mesh have revealed that in this case the dry content of the tissue paper web upstream from the nip is essentially equal to the dry content of the tissue paper web downstream from the nip.

To increase production further during operation of the machine with the non-structured skin, for example the felt, it can make sense for the tissue paper web to bypass the dewatering apparatus, meaning it is not to be dewatered at all by the dewatering apparatus.

On the one hand the voluminous and more absorbent tissue paper is produced, meaning formed, on the structured mesh and dewatered as it travels to the nip, formed by the cylindrical surface of the drying cylinder and the cylindrical surface of the suction press roller, and is dewatered thereby more by the dewatering apparatus than by the nip. In this case the dewatering takes place less by way of the nip. The latter essentially has the job of transferring the tissue paper from the mesh to the cylindrical surface of the drying cylinder. As tests have shown, a good transfer is provided when the linear force generated in the nip is less than 120 kN/m, in particular 60-90 kN/m.

On the other hand the less voluminous and less absorbent tissue paper is formed on the felt and dewatered by the nip formed by the cylindrical surface of the drying cylinder and the cylindrical surface of the suction press roller. The tissue paper is dewatered more by the nip than by the dewatering apparatus. As the dewatering takes place more by way of the nip than by way of the dewatering apparatus, the nip essentially has the job of dewatering the tissue paper and transferring the tissue paper from the mesh to the cylindrical surface of the drying cylinder.

The bores are preferably arranged and constructed such that the tissue paper web, downstream from the nip, in both operating modes of the machine, meaning with the structured and with the non-structured skin, has a dry content of 31% or more. A dry content of 31-36% is obtained downstream from the nip during operation with the structured skin and a dry content of 37-41% is obtained downstream from the nip during operation with the non-structured skin. In order to reduce, or even prevent, the marking of this tissue paper, particularly during the production of the voluminous tissue paper, and at the same time to provide a sufficient dewatering performance, it makes sense for the bores to have a diameter of less than 3.8 mm, in particular less than 3.5 mm.

It is also an object of the present invention to propose a machine for the production of tissue paper with a nip formed by a drying cylinder and a mating surface, with which it is possible, without the use of a shoe press unit in the nip, to produce both high-quality voluminous and less high-quality and less voluminous tissue paper, and to do so without marking, with good transfer performance and with sufficient dry content.

The machine for the production of a tissue paper web has, a nip formed between the cylindrical surface of a drying cylinder, in particular a Yankee drying cylinder, and a mating surface, through which the tissue paper web can be conveyed together with a permeable skin, namely between the skin and the cylindrical surface.

In one embodiment of a machine according to the present invention provision is made in addition for the mating surface to be formed by the cylindrical surface of a press roller, whereby the press roller has a suction zone and provision is made in the cylindrical surface for bores communicating with the suction zone. The bores have a diameter of less than 3.8 mm.

Through the provision of an evacuated press roller, which forms a nip with the cylindrical surface of a drying cylinder, in particular a Yankee drying cylinder, a press configuration is proposed which makes do without a shoe press unit. The press configured is capable of providing a good transfer from the skin to the cylindrical surface of the drying cylinder both for voluminous and less voluminous tissue paper, as the formation of a vacuum in the opening nip is counteracted by the provision of bores. As the result of the bores being evacuated, a sufficient dewatering performance is provided, in particular for the production of less voluminous tissue paper, as rewetting at the opening nip is at least greatly reduced. Surprisingly, the sufficient dewatering performance can also be provided when the bores have a diameter of less than 3.8 mm, without this resulting in any marking of in particular the soft and voluminous tissue paper.

The bore diameters according to the present invention are so small that a soft and voluminous tissue paper web cannot be pressed into the holes on account of the tensioned mesh, in particular the structured mesh. A result of which is that it is not only possible to obtain a uniform crêpe profile but also possible to improve the transfer of the voluminous and soft tissue paper web to the drying cylinder.

Provision is made for the machine to have a forming section for forming the tissue paper web from a pulp suspension and a skin arranged, such that the tissue paper web is formed in the forming section on the skin, which is conveyed through the nip formed between the cylindrical surface of the drying cylinder and the cylindrical surface of the press roller. As such, the tissue paper web can be conveyed on the same skin from its formation to beyond the nip, thus ruling out transfer problems. It makes sense, particularly in order to increase the dry content during production of the voluminous tissue paper, for a dewatering apparatus to be provided between the forming section and the nip.

For the production of voluminous tissue paper the skin is a structured mesh, in particular a TAD mesh. On the side facing the tissue paper web the structured mesh includes depressed regions and, relative to the depressed areas, raised regions, whereby the tissue paper web is formed in the depressed and raised regions of the structured mesh. In this case, the formed tissue paper web has voluminous pillow areas in the depressed regions of the structured mesh and, in between, less voluminous areas formed in the raised regions of the structured mesh, whereby the voluminous areas have a higher gsm substance than the less voluminous areas. Due to the depressed regions, the areas of the tissue paper web formed in the depressed regions remain protected therein during the subsequent dewatering—this is because the tissue paper web remains on the structured mesh after the tissue paper web is formed. This results in the tissue paper web being pressed only slightly under the action of pressure, which is why its voluminous structure is preserved during the dewatering through the application of pressure. As such, typically only 25-35% of the tissue paper web is pressed when pressure is applied.

With regard to the structure of the structured mesh and with regard to the formation of the tissue paper web on the structured mesh, reference is made to PCT/EP2005/050203, which herewith is included in full in this application.

For the production of less voluminous and less high-quality tissue paper the skin used is a felt.

As tests have shown, a sufficient dewatering, and the nearly complete reduction of markings on the tissue paper web, can be provided simultaneously when the bores have a diameter of 3.5 mm or less, preferably 3.0 mm or less, and in particular preferably 2.7 mm or less.

Furthermore it has been found that the dewatering performance, but not the marking behavior, is influenced by the open area in the cylindrical surface of the press roller. With the above mentioned bore diameters the best results, with regard to dewatering performance, are achieved when an open area of 16% to 30%, preferably 18% to 26%, in particular preferably 20% to 22% of the total area of the cylindrical surface, is formed by the bores. Furthermore it has been found that a good dewatering performance can be provided when the bores on the cylindrical surface of the press roller form a regular pattern in at least some areas.

To improve the transfer properties of the tissue paper web from the skin onto the cylindrical surface of the drying cylinder the cylindrical surface includes blind bores which are non-communicating with the vacuum zone and have a diameter of 2.7 mm or less, in particular 2.4 mm or less, whereby the blind bores on the cylindrical surface can be arranged, at least in some areas, between the bores.

Together, the bores and the blind bores form an open area of 16% to 30%, preferably 18% to 26%, in particular preferably 20% to 22% of the total area of the cylindrical surface. For the further improvement of the dewatering performance the bores and the blind bores on the cylindrical surface of the press roller form together a regular pattern, at least in some areas. The bores or the bores and the blind bores on the cylindrical surface can be arranged along a multiplicity of mutually parallel lines, for example.

Also, tests have shown that the transfer of the tissue paper web from the skin to the cylindrical surface of the drying cylinder can be improved when the press roller is driven.

The dewatering apparatus includes a dewatering section and a pressure apparatus. The dewatering apparatus is constructed such that the tissue paper web can be conveyed along the dewatering section between the structured skin, in particular the structured mesh, and a further permeable skin, and that by way of the pressure apparatus pressure can be exerted on the structured mesh, the tissue paper web and the further permeable skin such that the tissue paper web is dewatered in the direction of the further permeable skin. The further permeable skin is preferably a felt having a sufficiently high water absorption capacity for the water, which is pressed out of the tissue paper web. With regard to the structure of the lower skin, reference is made to PCT/EP2005/050198, which herewith is included in full in this application.

The compressibility (change of thickness in mm upon application of force in N) of the structured mesh is preferably smaller than the compressibility of the further permeable skin. The voluminous structure of the tissue paper web upon the application of pressure is thus retained. Tests have shown that a particularly good and gentle dewatering is possible when the dynamic rigidity (K), as a measure for the compressibility of the structured mesh, is 3000 N/mm or more.

Given a hard or excessively hard further permeable skin, the voluminous pillow areas of the tissue paper web would not be compressed at all. Due to the compressible structure of the further permeable skin the voluminous pillow areas of the tissue paper are slightly pressed and hence gently dewatered. Tests in this connection have shown that the dynamic rigidity (K), as a measure for the compressibility of the further permeable skin, is 100,000 N/mm or less, preferably 90,000 N/mm, in particular preferably 70,000 N/mm or less. Similarly it is an advantage for the G modulus, as a measure for the elasticity of the further permeable skin, to be 2 $N/mm^2$ or more, and preferably 4 $N/mm^2$ or more.

Also, tests have shown that the water stored in the further permeable skin, for example felt, can be expelled more easily with a gas flow when the permeability of the further permeable skin is not too high. It proves to be an advantage when the permeability of the further permeable skin is 80 cfm or less, preferably 40 cfm or less, and in particular preferably 25 cfm or less. In the above mentioned ranges the rewetting of the tissue paper web by the further permeable skin is largely prevented.

The pressure exerted here on the arrangement of a structured mesh, tissue paper web and further permeable skin can be generated by a gas flow. In addition or alternatively to this, the pressure exerted can be generated by a mechanical pressing force. Preferably a gas flow can be generated by the pressure apparatus such that in order to dewater the tissue paper web, first the structured mesh is charged with gas, then the tissue paper web and finally the further permeable skin. The dewatering of the paper web takes place in this case in the direction of the further permeable skin.

In addition or optionally to gas charging of the above mentioned arrangement provision can be made for the pressure apparatus to include a tensioned press belt, which is arranged such that the arrangement of structured mesh, tissue paper web and further permeable skin can be conveyed, at least in some areas along the dewatering section, between the press belt and a smooth surface. The press belt acts on the structured mesh and the further permeable skin rests on the smooth surface. In this case, too, the dewatering of the paper web takes place in the direction of the further permeable skin.

The arrangement of structured mesh, tissue paper web and further permeable skin is preferably charged with the gas flow, at least in some areas in the region of the dewatering section, so that the dewatering takes place simultaneously by the pressing force of the press belt and the through-flow of gas. Tests have shown that the gas flow through the tissue paper web amounts to approx. 150 $m^3$ per minute along the dewatering section.

The pressing force can be increased by a high tension of the press belt. Tests have shown that sufficient dewatering, particularly of the non-voluminous areas of the tissue paper, is obtained when the press belt is under a tension of at least 30 kN/m, preferably at least 60 kN/m or 80 kN/m. Here the press belt can have a spiralized structure and be constructed as a so-called spiral link fabric, for example. Furthermore, it is possible for the press belt to have a woven structure.

To be able to obtain a good dewatering of the tissue paper web by the mechanical tensioning of the press belt and as the result of the gas flow through the press belt the press belt has an open area of at least 25% and a contact area of at least 10% of its total area facing the upper skin. A uniform mechanical pressure is exerted on the arrangement of the structured upper skin and lower skin by increasing the contact area of the press belt.

Satisfactory results are obtained with all the values, stipulated below, for the contact area and open area of the press belt. Provision is made accordingly for the press belt to have an open area of between 75% and 85% and a contact area of between 15% and 25% of its total area facing the upper skin. Also, provision is made for the press belt to have an open area of between 68% and 76% and a contact area of between 24% and 32% of its total area facing the upper skin. Very good results with regard to dry content and voluminosity of the tissue paper are obtained when the press belt has an open area of between 51% and 62% and a contact area of between 38% and 49% of its total area facing the upper skin. In particular through the construction of the press belt, with a woven structure, it is possible for the press belt to have an open area of 50% or more and a contact area of 50% or less of its total area facing the upper skin. As such it is possible to provide for a good gas flow through the press belt as well as a homogeneous pressing force by way of the press belt.

The smooth surface is formed by the circumferential surface of a roller. Here the gas flow can be generated by a suction zone in a roller. In this case the suction zone has a length in the range between 200 mm and 2500 mm, preferably between 800 mm and 1800 mm, in particular preferably between 1200 mm and 1600 mm. The vacuum in the suction zone amounts to between −0.2 bar and −0.8 bar, preferably between −0.4 bar and −0.6 bar. Optionally or in addition to this, the gas flow can also be generated by an excess pressure hood arranged above the top skin.

The temperature of the gas flow is between 50° C. and 180° C., preferably between 120° C. and 150° C., and the excess pressure amounts to less than 0.2 bar, preferably less than 0.1 bar and in particular preferably less than 0.05 bar. The gas can be hot air or steam.

Through the above described dewatering operation it is possible for the tissue paper web to leave the dewatering section with a dry content of more than 30%.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
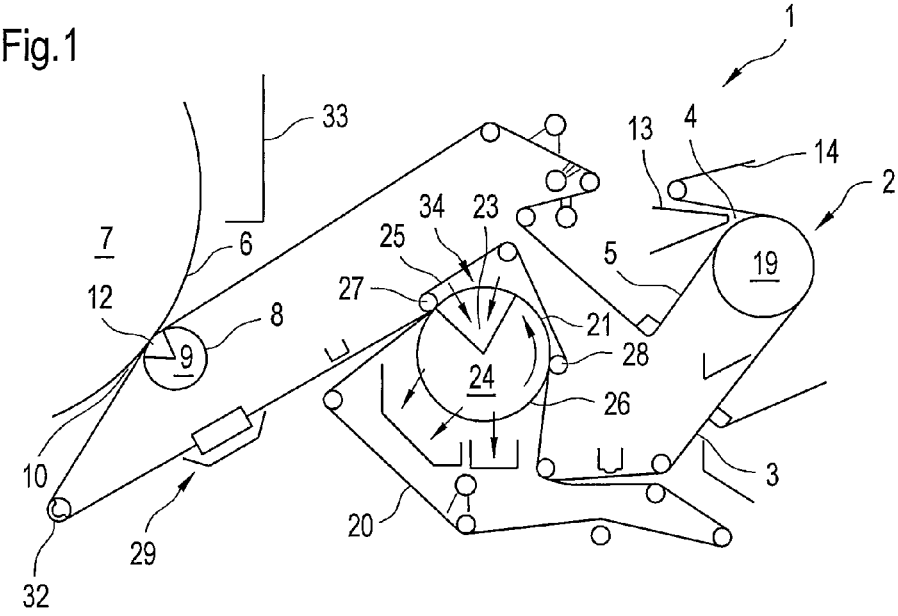
FIG. 1 shows a machine according to one embodiment of the present invention in the configuration for the production of high-quality tissue paper.
Figure 2:
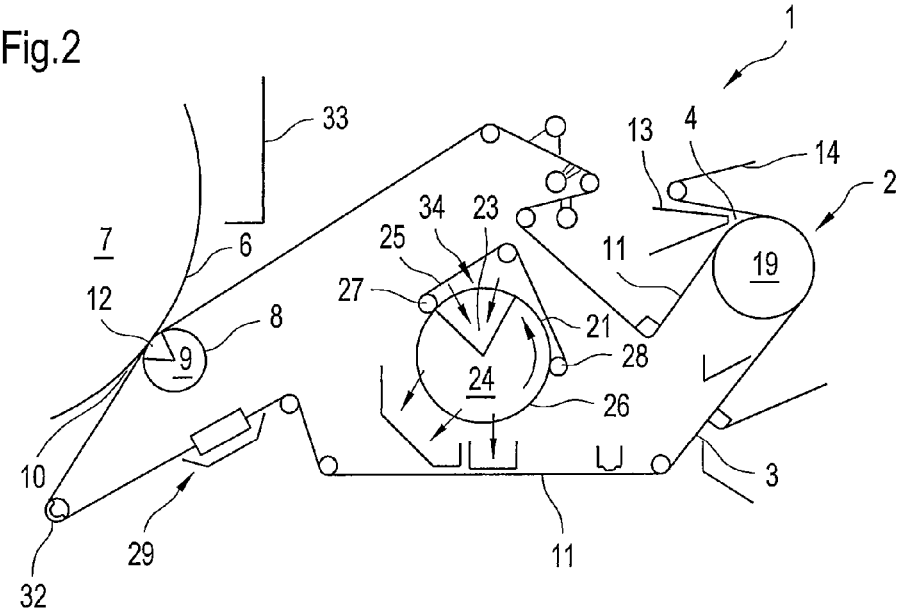
FIG. 2 shows the machine from FIG. 1 in the configuration for the production of less high-quality tissue paper.

Referring now to the drawings, and more particularly to FIG. 1 there is shown a tissue paper machine 1 with a forming section 2 in which a tissue paper web 3 is formed from a pulp suspension 4 on a skin 5 (or 11 of FIG. 2) and with a nip 10 that is formed between cylindrical surface 6 of a Yankee drying cylinder 7 and cylindrical surface 8 of a press roller 9 and through which tissue paper web 3 can be conveyed together with skin 5 or 11. According to the present invention the configuration of machine 1 is variable, such that depending on the quality of tissue paper 3 to be produced, for example its absorbency or tear resistance, either a structured mesh 5 or a felt 11 (this configuration is shown in FIG. 2) is used. Press roller 9 includes a suction zone 12 and bores 30 communicating with suction zone 12 which are provided in the cylindrical surface 8 of the press roller 9.

In the configurations presented in the FIGS. 1 and 2 structured mesh 5 is used for the production of tissue paper 3 with higher absorbency and felt 11 is used for the production of tissue paper 3' with lower absorbency.

In the configuration of FIG. 1 tissue paper web 3 is conveyed through a dewatering apparatus 34 arranged between forming section 2 and nip 10 and dewatered by the apparatus. By contrast, in the configuration of machine 1 shown in FIG. 2 tissue paper web 3 is not conveyed through dewatering apparatus 34 arranged between forming section 2 and nip 10 and hence is not dewatered by apparatus 34.

The method for the production of high-quality voluminous and absorbent tissue paper 3 with the configuration of machine 1 according to FIG. 1 will be explained with reference to the FIGS. 3-6. Pulp suspension 4 emerges from a headbox 13 such that suspension 4 is injected into the ingoing nip between a forming mesh 14 and the structured, in particular 3-dimensionally structured mesh 5, as the result of which a tissue paper web 3 is formed.

Forming mesh 14 has a side 15 facing tissue paper web 3, which relative to side 16 of structured mesh 5 facing tissue paper web 3 is smooth. Here side 16 of structured mesh 5 facing tissue paper web 3 has depressed regions 17 and, relative to depressed areas 17, raised regions 18 such that tissue paper web 3 is formed in depressed regions 17 and raised regions 18 of structured mesh 5. The difference in height between depressed regions 17 and raised regions 18 amounts to preferably 0.07 mm and 0.6 mm. The area formed by raised regions 17 amounts to preferably 10% or more, in particular preferably 20% or more and in particular preferably 25% to 30% of side 16 facing tissue paper web 3. In the embodiment presented in FIG. 3 structured mesh 5 is constructed as a TAD mesh 5.

Figure 3:
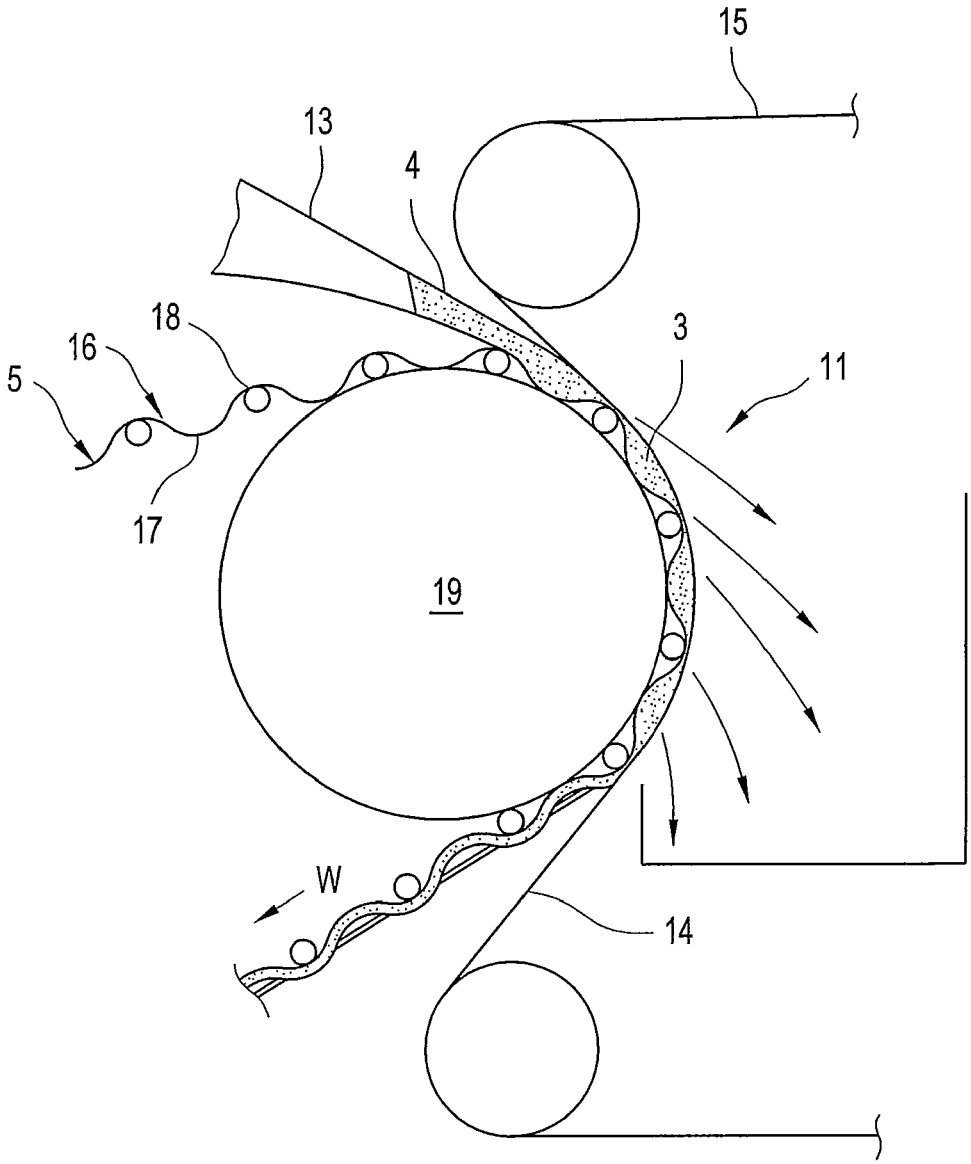
FIGS. 3-6 show a method for the production of tissue paper with the configuration for the machine of FIG. 1.

In the embodiment of the present invention presented in FIG. 3 the arrangement of TAD mesh 5, tissue paper web 3 and forming mesh 14 is directed around a forming roller 19 and tissue paper web 3 is dewatered essentially by forming mesh 14 before forming mesh 14 is taken off tissue paper web 3 and tissue paper web 3 is transported further on TAD mesh 5.

Figure 4:
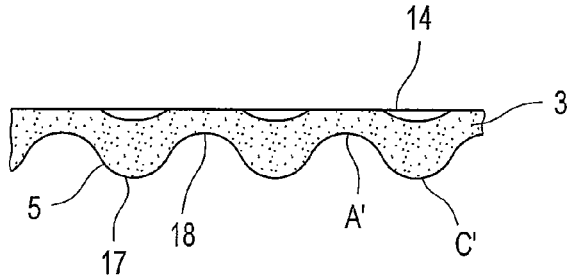

Evident in FIG. 4 is the structure of tissue paper web 14 formed between flat forming mesh 14 and TAD mesh 5. Voluminous pillow areas C' of tissue paper web 3 formed in depressed regions 16 of TAD mesh 5 have a higher volume and a higher gsm substance than areas A' of tissue paper web 3 formed in raised regions 18 of TAD mesh 5.

Accordingly, tissue paper web 3 already has a 3-dimensional structure as the result of its forming on structured mesh 5.

Figure 5:
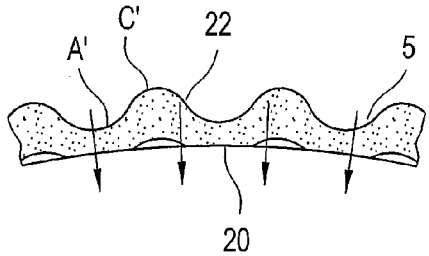

In the configuration presented in FIG. 1 tissue paper web 3 is conveyed between structured mesh 5, which is arranged above, and a further permeable skin 20, which is constructed as felt 20, whereby during the dewatering step along a dewatering section 21 pressure is exerted on structured mesh 5, tissue paper web 3 and felt 20 such that tissue paper web 3 is dewatered in the direction of felt 20, as indicated by arrows 22 in FIG. 5. Here the fibers of tissue paper web 3 are pressed against felt 20, as the result of which, the side of tissue paper web 3 brought into contact with felt 20 becomes nearly flat.

As the result of tissue paper web 3 being dewatered during this dewatering step in the direction of felt 20 and as the result of tissue paper web 3 being dewatered on structured mesh 5 on which it was previously formed, voluminous areas C' are less intensively compressed than areas A', thus resulting in the voluminous structure of areas C' being preserved.

The pressure for dewatering tissue paper web 3 is generated during the dewatering step, at least in some areas, simultaneously by a gas flow and a mechanical pressing force.

Here the gas flow passes first through structured mesh 5, then tissue paper web 3, and finally the further skin constructed as felt 20. The gas flow through tissue paper web 3 amounts to around 150 $m^3$ per minute and meter web length. The gas flow is generated by a suction zone 23 in a roller 24, suction zone 23 having a length in the region of between 200 mm and 2500 mm, preferably between 800 mm and 1800 mm, and in particular preferably between 1200 mm and 1600 mm. The vacuum in suction zone 23 amounts to between −0.2 bar and −0.8 bar, preferably between −0.4 bar and −0.6 bar.

With regard to performing the dewatering step by mechanical pressing force and, optionally, or in addition, with a gas flow, and with regard to the various configurations of apparatus for performing such a dewatering step, PCT/EP2005/050198 is included in full in the disclosure content of this current application.

The mechanical pressing force is generated during the dewatering step by conveying the arrangement of structured mesh 5, tissue paper web 3 and felt 20 to a dewatering section 21 between a tensioned press belt 25 and a smooth surface 26, in which case press belt 25 acts on structured mesh 5 and felt 20 rests on smooth surface 26. Smooth surface 26 is formed by circumferential surface 26 of roller 24.

Dewatering section 21 is defined essentially by the wrap zone of press belt 25 around circumferential surface 26 of roller 24, whereby the wrap zone is defined by the distance between the two deflector rollers 27 and 28.

Press belt 25 is under a tension of at least 30 kN/m, preferably at least 60 kN/m or 80 kN/m, and has an open area of at least 25% and a contact area of at least 10% of its total area facing the upper skin. In this specific case, press belt 25 is constructed as a spiral link fabric and has an open area of between 51% and 62% and a contact area of between 38% and 49% of its total area facing the upper skin.

With regard to the structure of the press belt, PCT/EP2005/050198 is hereby included in full in the disclosure content of this present application.

Tissue paper web 3 leaves dewatering section 21 with a dry content of 30% or more. After the dewatering step tissue paper web 3 can be subjected to an additional drying step performed by implied apparatus 29.

Before tissue paper web 3 runs through nip 10, tissue paper web 3 is conveyed together with structured mesh 5 around an evacuated deflector roller 32, whereby structured mesh 5 is arranged between tissue paper web 3 and evacuated deflector roller 32. Moisture can thus be drawn out of structured mesh 5.

Figure 6:
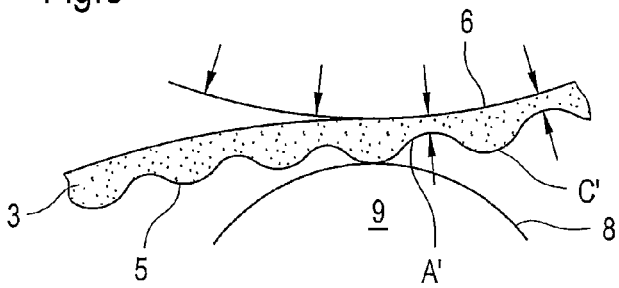

After the dewatering step performed by dewatering apparatus 19 tissue paper web 3 is conveyed together with structured mesh 5 through nip 10, whereby tissue paper web 3 in nip 10 is arranged between structured mesh 5 and smooth roller surface 6 of a Yankee drying cylinder 7 (see FIG. 6). Here nip 10 is formed by Yankee drying cylinder 7 and a shoe press roller 9.

On the side, which was formed on flat forming mesh 15 and in whose direction tissue paper web 3 was dewatered in dewatering apparatus 34, tissue paper web 3 rests with a relatively large area amounting to 90% or more of the total area of this side on Yankee drying cylinder 7, while on the other side, tissue paper web 3 rests on structured mesh 5.

The linear force generated in nip 10 amounts to 60-90 kN/m, so that essentially only a transfer of tissue paper web 3 from structured mesh 5 to Yankee drying cylinder 7 is effected by nip 10.

Figure 7:
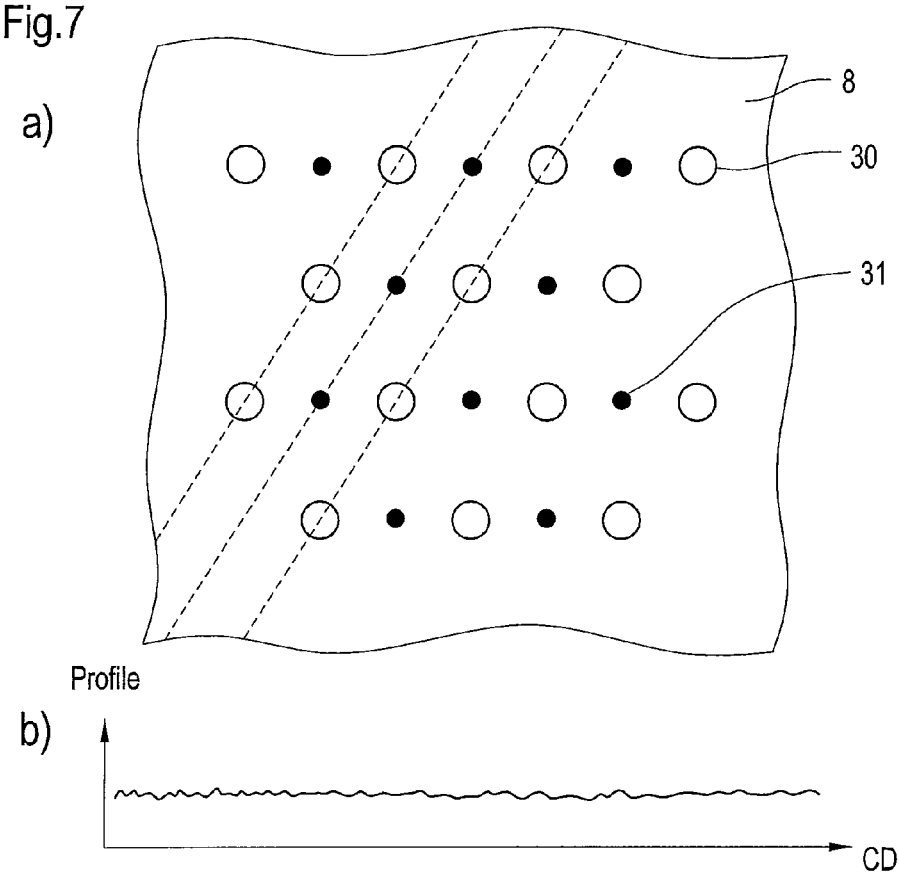
FIG. 7 shows the cylindrical surface of a suction press roller with small bores according to the present invention and the transverse profile of a tissue paper web produced therewith.

As press roller 9 has bores 30 and 31, as shown in FIG. 7, in its cylindrical surface 8, a good transfer of tissue paper web 3 is assured. Furthermore, press roller 9 is driven, whereby the transfer of tissue paper web 3 from structured mesh 5 to Yankee drying cylinder 7 is improved further.

Downstream from nip 10 tissue paper web 3 is conveyed over heated cylindrical surface 6 of Yankee drying cylinder 7 and then taken off of cylinder 7 with a crêpe doctor (not illustrated). To increase the drying performance, a drying hood 33 can be arranged in addition, above Yankee drying cylinder 7 such that tissue paper web 3 is conveyed between drying hood 33 and cylindrical surface 6 of Yankee drying cylinder 7.

FIG. 7*a* shows a plane view of a detail of cylindrical surface 8 of evacuated press roller 9. Cylindrical surface 8 has bores 30 and 31. Bores 30 communicate with suction zone 12 of press roller 9, meaning they are in fluidic connection with suction zone 12 of press roller 9. Bores 30 have a diameter of 2.9 mm, which prevents marking of tissue paper 3 while passing through nip 10. Furthermore, blind bores 31, with a smaller diameter than that of bores 30, are arranged on cylindrical surface 8 between bores 30. In the embodiment under consideration blind bores 31 have a diameter of 2.4 mm. Due to blind bores 31 the marking of tissue paper 3 is reduced further. An open area of 22% of the total area of cylindrical surface 8 is formed by bores 30 and blind bores 31 together, whereby bores 30 and blind bores 31 together form a regular pattern on cylindrical surface 8 of press roller 9.

In this specific case, bores 30 and blind bores 31 on cylindrical surface 8 are arranged along a multiplicity of mutually parallel lines (implied by the dashed lines). FIG. 7*b* shows the transverse profile of the produced tissue paper web 3 as it exists after creping following the rotation around Yankee drying cylinder 7. As the result of bores 30 and blind bores 31 having a small diameter, no marking of tissue paper 3 in nip 10 occurs, meaning that the profile of tissue paper web 3 is uniform.

Figure 8:
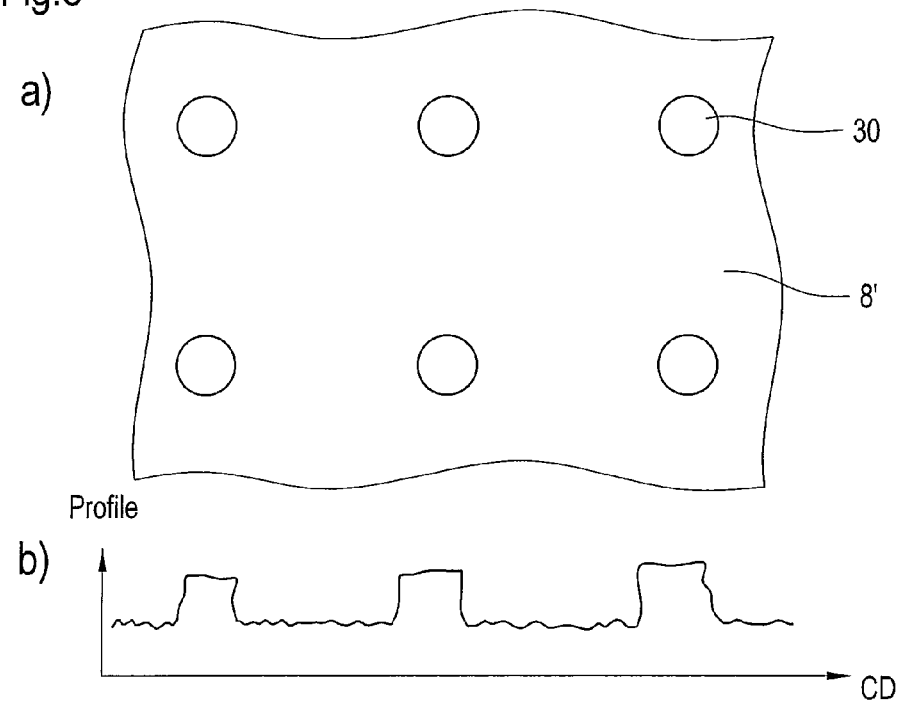
FIG. 8 shows the cylindrical surface of a suction press roller with large bores known from the prior art and the transverse profile of a tissue paper web produced therewith.

For comparison, FIG. 8*b* shows a transverse profile of a tissue paper web as it exists after creping following the rotation around Yankee drying cylinder 7. The tissue paper web, shown in FIG. 8*b*, was produced under the same conditions as tissue paper web 3, the sole difference being that cylindrical surface 8' of press roller 9' used in nip 10 has bores with a diameter of 3.8 mm or more. As can be seen, the profile has elevations which correlate with bores 30' (FIG. 8*a*).

Figure 11:
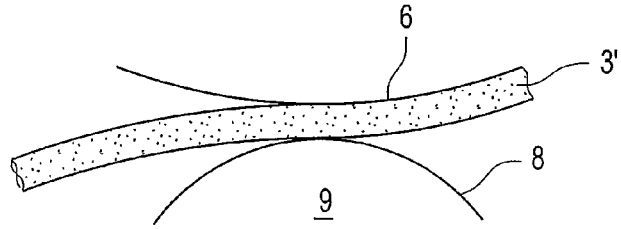
FIGS. 9-11 show the method for the production of tissue paper with the configuration of the machine from FIG. 2.

The method for the production of less high-quality and less voluminous and absorbent tissue paper 3' with the configuration of the machine according to FIG. 2 will now be explained with reference to FIGS. 9-11.

Pulp suspension 4 emerges from headbox 13 such that suspension 4 is injected into the ingoing nip between a forming mesh 14 and the non-structured skin constructed as felt 11, as the result of which a tissue paper web 3' is formed.

Forming mesh 14 has a side 15 facing tissue paper web 3', which is approximately equally as smooth as side 34 of felt 11 facing tissue paper web 3'.

Figure 9:
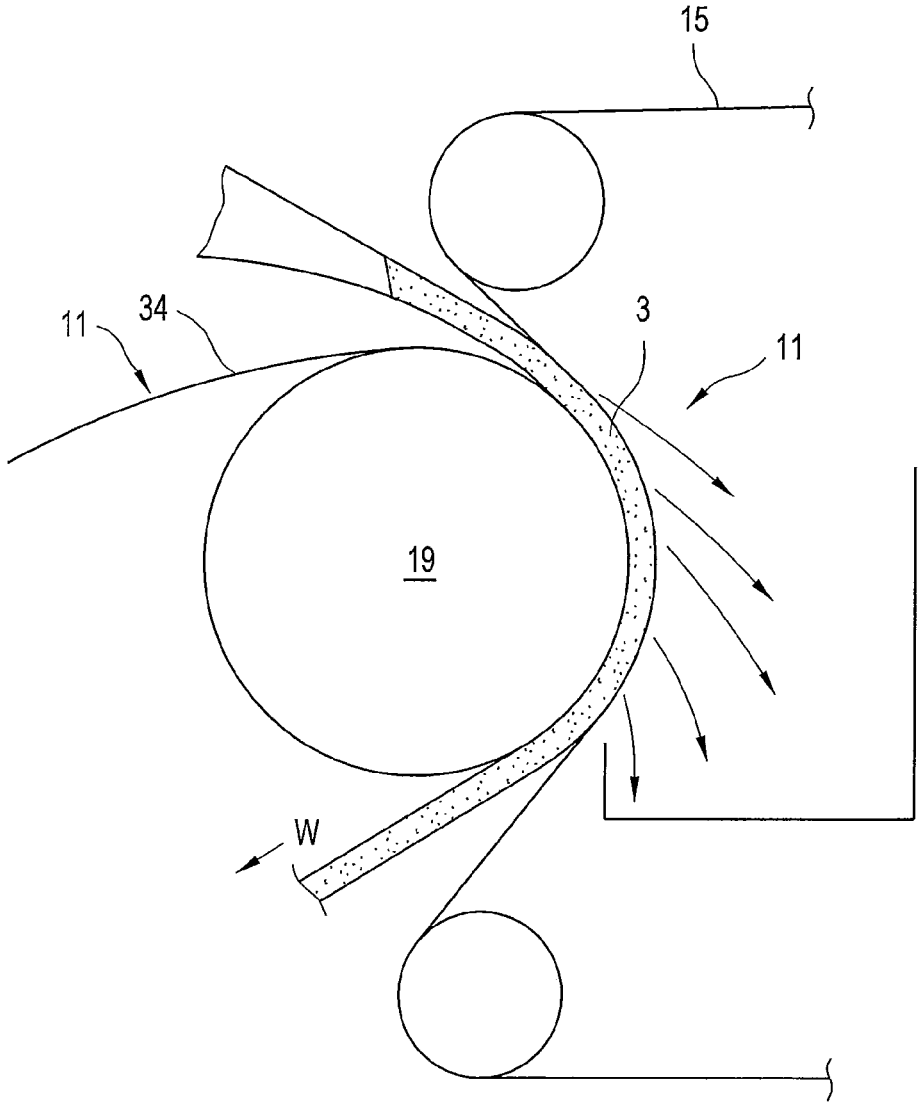

In an embodiment of the present invention as presented in FIG. 9 the arrangement of felt 11, tissue paper web 3' and forming mesh 14 is directed around forming roller 19 and tissue paper web 3' being dewatered essentially by forming mesh 14 before forming mesh 14 is taken off tissue paper web 3' and tissue paper web 3' is transported further on felt 11.

Figure 10:
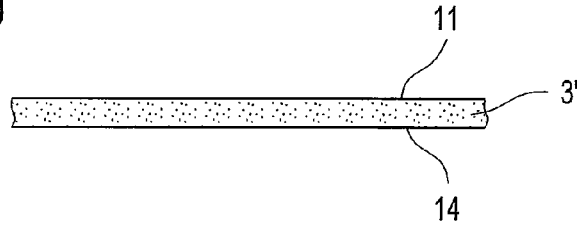

Evident in FIG. 10 is the two-sided smooth structure of tissue paper web 3' formed between flat forming mesh 14 and felt 11. Here tissue paper web 3' is conveyed through dewatering apparatus 34 arranged between forming section 2 and nip 10 and dewatered accordingly by apparatus 34. Tissue paper web 3' can be dewatered by a drying step performed by implied apparatus 29.

Before tissue paper web 3' runs through nip 10, tissue paper web 3' is conveyed together with felt 11 around the evacuated deflector roller 32, whereby felt 11 is arranged between tissue paper web 3' and the evacuated deflector roller 32. In this way, so much moisture can be drawn from felt 11 as to enable it to pick up sufficient moisture pressed from tissue paper web 3' in the subsequent dewatering step in nip 10.

After this, tissue paper web 3' together with felt 11 is conveyed in a dewatering step through nip 10, whereby tissue paper web 3' in nip 10 is arranged between felt 11 and smooth roller surface 6 of Yankee drying cylinder 7. Here nip 10 is formed by Yankee drying cylinder 7 and a shoe press roller 9. The linear force generated in nip 10 amounts to 120 kN/m, so that a dewatering of tissue paper web 3' and a subsequent transfer of tissue paper web 3' from felt 11 to Yankee drying cylinder 7 is effected by nip 10. FIG. 11 shows tissue paper web 3' while passing through nip 10.

In its cylindrical surface 8 press roller 9 has bores 30 which communicate with the suction zone 12 of press roller 9, hence rewetting in the opening nip is prevented, as the result of which, the dry content of tissue paper web 3' is increased. Also, due to the bores a good transfer of tissue paper web 3' to Yankee drying cylinder 7 is assured. Furthermore, press roller 9 is driven, whereby the transfer of tissue paper web 3' from felt 11 to Yankee drying cylinder 7 is improved further.

Downstream from nip 10 tissue paper web 3' is conveyed over the heated cylindrical surface 6 of Yankee drying cylinder 7 and then taken off cylinder 7 with a crêpe doctor, not illustrated. To increase the drying performance a drying hood 33 can be arranged above Yankee drying cylinder 7 such that tissue paper web 3' is conveyed between drying hood 33 and cylindrical surface 6 of Yankee drying cylinder 7.

As tissue paper web 3' has an essentially more compact structure than tissue paper web 3 formed with the configuration of FIG. 1, there is no risk with tissue paper web 3' of it being marked in nip 10 on account of bores 30 and 31.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. A method of producing a tissue paper web in a papermaking machine, comprising the steps of:

forming the tissue paper web in a forming section of the machine from a pulp suspension on a skin;

selecting a quality of tissue paper to produce in the machine thereby defining a quality selection, said quality being absorbency or tear resistance;

bypassing a dewatering apparatus with the tissue paper web and selecting a type of said skin dependent upon said quality selection, the machine being configured to bypass said dewatering apparatus dependent upon said quality selection, when said quality selection is said tear resistance then said skin is one of a non-structured skin and a felt and said dewatering apparatus is bypassed, when said quality selection is said absorbency then said skin is one of a three-dimensionally structured skin and a structured mesh and said dewatering apparatus is not bypassed;

passing said skin and the tissue paper web through a nip defined between a cylindrical surface of a drying cylinder and a mating surface of a press roller, said mating surface of said press roller has a cylindrical surface, said cylindrical surface of said press roller having a plurality of bores therein; and conveying the tissue paper web to said drying cylinder from said skin.

2. The method of claim 1, wherein said mating surface includes a suction zone, at least some of said plurality of bores communicating with said suction zone, said bores having a diameter of less than 3.8 mm, said plurality of bores having a total open area of between 16% and 30% of a cylindrical surface area of said press roller.

3. The method of claim 2, wherein said bores have a diameter of one of equal to and less than 3.5 mm.

4. The method of claim 3, wherein said diameter of one of equal to and less than 3.0 mm.

5. The method of claim 4, wherein said diameter of one of equal to and less than 2.7 mm.

6. The method of claim 2, wherein said total open area is between 18% and 26%.

7. The method of claim 6, wherein said total open area is between 20% and 22%.

8. The method of claim 1, further comprising the step of arranging and constructing said bores such that the tissue paper web immediately downstream from said nip when operating the machine with one of said structured mesh and said felt has a dry content of 31% or more.

9. The method of claim 8, wherein said bores on said cylindrical surface of said press roller are arranged in a regular pattern in at least some areas.

10. The method of claim 9, wherein some of said plurality of bores are blind bores which are non-communicating with said suction zone, said blind bores having a diameter of one of equal to and less than 2.7 mm.

11. The method of claim 10, wherein said diameter of said blind bores is one of equal to and less than 2.4 mm.

12. The method of claim 10, wherein said blind bores on said cylindrical surface are arranged between said bores in at least some areas and form a regular pattern in at least some areas.

13. The method of claim 10, wherein said arranging step includes arranging said bores and said blind bores on said cylindrical surface along a multiplicity of mutually parallel lines.

14. The method of claim 13, further comprising the step of pressurization of one of said structured skin and said structured mesh with the tissue paper web by way of a permeable skin in the dewatering apparatus, said structured skin and said structured mesh including depressed regions and raised regions, during pressurization in said dewatering apparatus the tissue paper web is compressed less intensively in said depressed regions than in said raised regions.

15. The method of claim 14, wherein a compressibility of said structured skin is less than that of said permeable skin.

16. The method of claim 15, wherein a dynamic rigidity (K) is a measure for the compressibility of said structured skin, said dynamic rigidity (K) being one of equal to and more than 3,000 N/mm and a dynamic rigidity (K) of the compressibility of said permeable skin is one of equal to and less than 100,000 N/mm.

17. The method of claim 16, wherein a G modulus is a measure for an elasticity of said permeable skin, said G modulus being one of equal to and more than 2 $N/mm^2$.

18. The method of claim 17, wherein said G modulus is one of equal to and more than 4 $N/mm^2$.

19. The method of claim 1, further comprising the step of generating a linear force in said nip of less than 120 kN/m.

* * * * *